US009233273B2

(12) United States Patent
Wang

(10) Patent No.: US 9,233,273 B2
(45) Date of Patent: Jan. 12, 2016

(54) RECUMBENT FITNESS EQUIPMENT WITH SYNCHRONIZED PEDALS AND ARMRESTS AND A SEAT ADJUSTMENT DEVICE

(71) Applicant: KEEN NEEK CO., LTD., Taichung (TW)

(72) Inventor: Chin-Liu Wang, Taichung (TW)

(73) Assignee: KEEN NEEK CO., LTD., Taichung (TW)

( * ) Notice: Subject to any disclaimer, the term of this patent is extended or adjusted under 35 U.S.C. 154(b) by 96 days.

(21) Appl. No.: 14/262,046

(22) Filed: Apr. 25, 2014

(65) Prior Publication Data

US 2015/0099610 A1 Apr. 9, 2015

(30) Foreign Application Priority Data

Oct. 3, 2013 (TW) ..... 102218502 U

(51) Int. Cl.
*A63B 22/06* (2006.01)

(52) U.S. Cl.
CPC ..... *A63B 22/0605* (2013.01)

(58) Field of Classification Search
CPC ..... A63B 22/001
USPC ..... 472/95–96; 434/247; 482/96
See application file for complete search history.

(56) References Cited

U.S. PATENT DOCUMENTS 7,837,604 B1 * 11/2010 Hsu ..... A63B 22/0056 482/137
2004/0259692 A1 * 12/2004 Martin ..... A63B 22/0007 482/52
2007/0021276 A1 * 1/2007 Kuo ..... A63B 21/005 482/62

* cited by examiner

*Primary Examiner* — Loan H Thanh
*Assistant Examiner* — Jennifer M Deichl
(74) *Attorney, Agent, or Firm* — Patent Office of Bang Shia

(57) ABSTRACT

A recumbent fitness equipment with synchronized pedals and armrests and a seat adjustment device includes a frame, a rotary wheel assembly, a pair of pedal assemblies, a pair of armrests, a seat mounting rack, and seat. When the user stamps the pedals, the armrests also move along with the pedals, so that the user's feet and hands can move simultaneously during exercise, so as to improve exercise effect. Besides, the distances from the seat member and the armrest rods to the pedal assemblies can be adjusted to meet the demands of different users.

7 Claims, 8 Drawing Sheets

RECUMBENT FITNESS EQUIPMENT WITH SYNCHRONIZED PEDALS AND ARMRESTS AND A SEAT ADJUSTMENT DEVICE

BACKGROUND OF THE INVENTION

1. Field of the Invention

The present invention relates to a recumbent fitness equipment, and more particularly to a recumbent fitness equipment with synchronized pedals and armrests and a seat adjustment device.

2. Description of the Prior Art

Recumbent fitness equipments usually comprise a seat on a stationary frame, and a pair of pedals disposed in front of the seat, so that the user can do exercises by sitting on the seat in an inclined position while pedaling the pedals.

Most of the existing recumbent fitness equipments only allow the user to do pedaling exercises, and the armrests and seat are static. Namely, the distances from the seat and the armrests to the pedals are fixed and unadjustable to fit users of different heights.

The present invention has arisen to mitigate and/or obviate the afore-described disadvantages.

SUMMARY OF THE INVENTION

The primary objective of the present invention is to provide a recumbent fitness equipment with synchronized pedals and armrests and a seat adjustment device, wherein the armrest move synchronously with the pedals, and the distances from the seat and the armrests to the pedals are adjustable to fit users of different heights.

To achieve the above objective, a recumbent fitness equipment with synchronized pedals and armrests and a seat adjustment device in accordance with the present invention, comprises: a frame, a rotary wheel assembly, a pair of pedal assemblies, a pair of armrests, a seat mounting rack, and seat. The rotary wheel assembly is provided with a belt wheel and a gravity wheel which is drivingly connected to the belt wheel by a belt, the belt wheel is rotatably fixed to the frame via a shaft which is inserted through the frame and the belt wheel. The pair of pedal assemblies each includes a said pedal with a crank which is fixed to one end of the shaft by a crank-fixing member, the crank-fixing member includes an eccentric hole via which the crank-fixing member is sleeved onto the shaft, and the pedal is fixed to the crank-fixing member via the crank. The pair of said armrests each includes a connecting rod and an armrest rod, the connecting rod has one end drivingly fixed to the crank-fixing member by a connecting member which is sleeved onto the crank-fixing member, and has another end pivoted to one end of the armrest rod, the armrest rod is provided at a lateral side thereof with a pivot portion. The seat mounting rack includes a plurality of mounting rods and a rail, the mounting rods are fixed to the frame, and the rail is fixed to the mounting rods and inclined toward the rotary wheel assembly. The seat is provided with a seat member, a slide member and a shaft coupler. The seat member is fixed on the rail, the slide member is slidably inserted in the rail, the shaft coupler includes a first section and a second section, the first section has one end pivoted to one end of the second section, and another end of the first section is pivotally connected to the slide member, another end of the second section is pivoted to the frame, the second section is pivotally connected to the pivot portion by a pivot shaft, so that the armrest rods are able to pivot with respect to the second section by rotating around the pivot shaft.

When the user stamps the pedals, the armrests also move along with the pedals, so that the user's feet and hands can move simultaneously during exercise, so as to improve exercise effect. Besides, the distance from the seat member and the armrest rods to the pedal assemblies can be adjusted to meet the demands of different users.

DETAILED DESCRIPTION OF THE PREFERRED EMBODIMENTS

Figure 1:
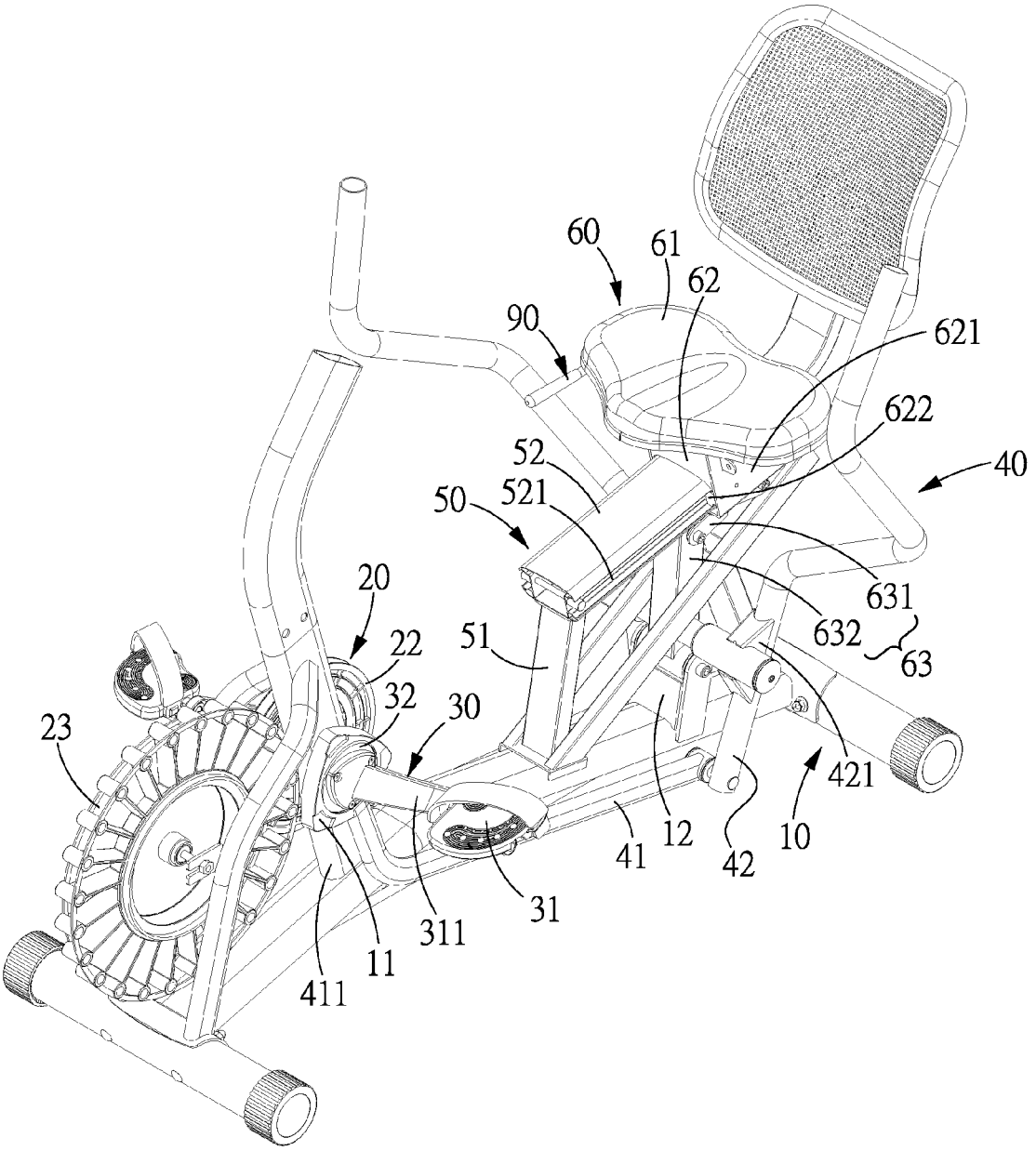
FIG. 1 shows a recumbent fitness equipment with synchronized pedals and armrests and a seat adjustment device in accordance with a preferred embodiment of the present invention.
Figure 2:
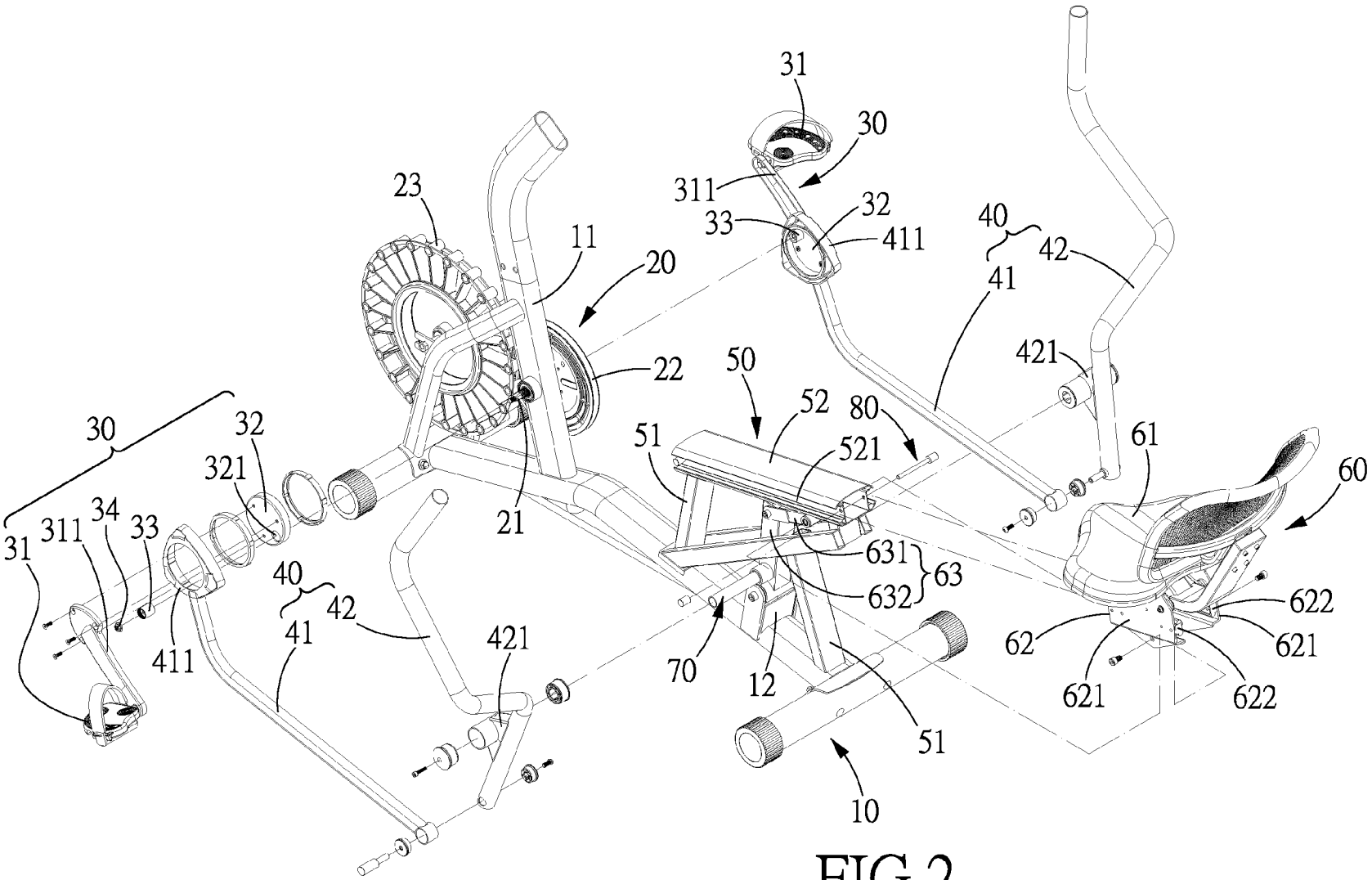
FIG. 2 is an exploded view of the recumbent fitness equipment in accordance with the present invention.
Figure 3:
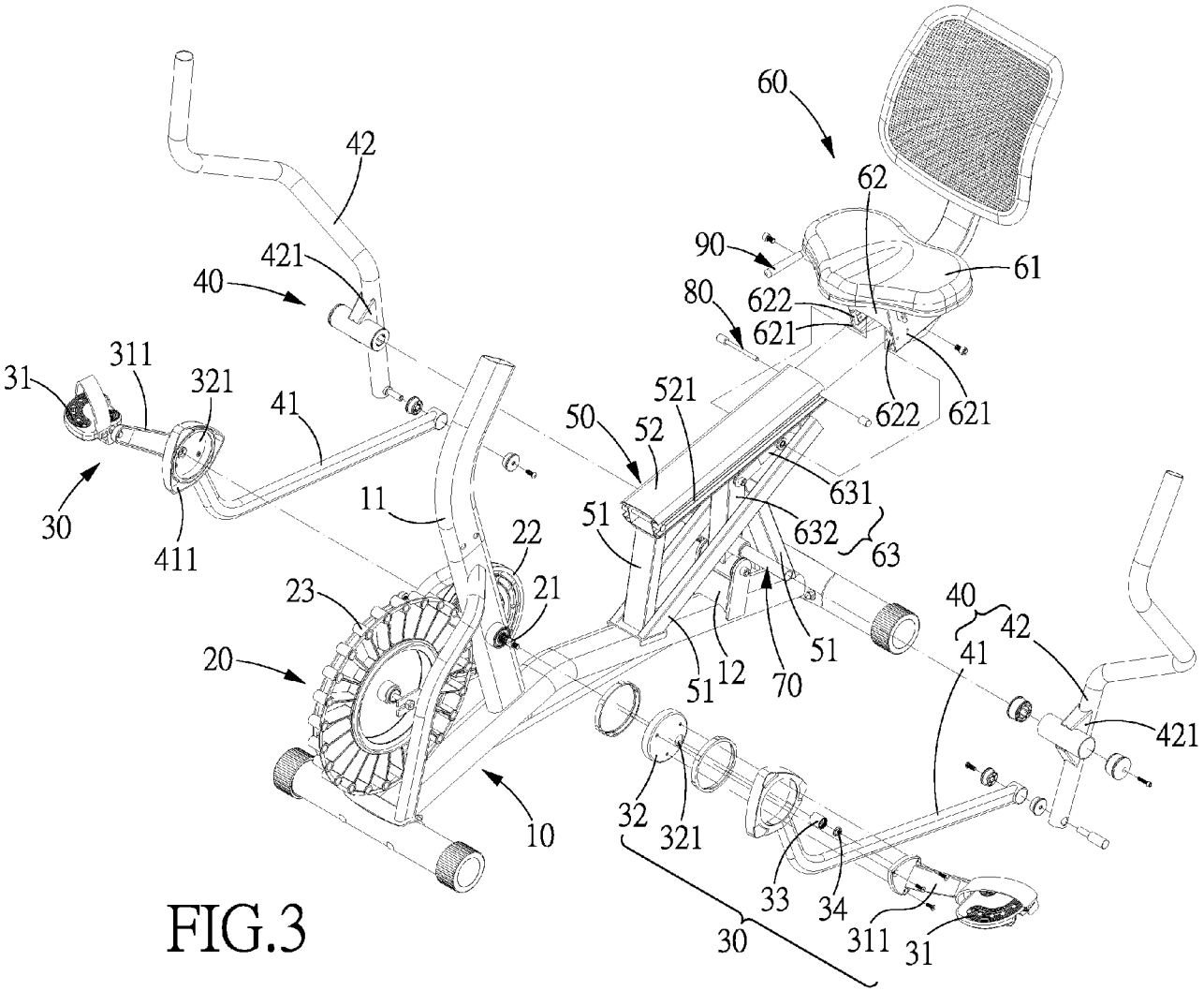
FIG. 3 is another exploded view of the recumbent fitness equipment in accordance with the present invention.
Figure 4:
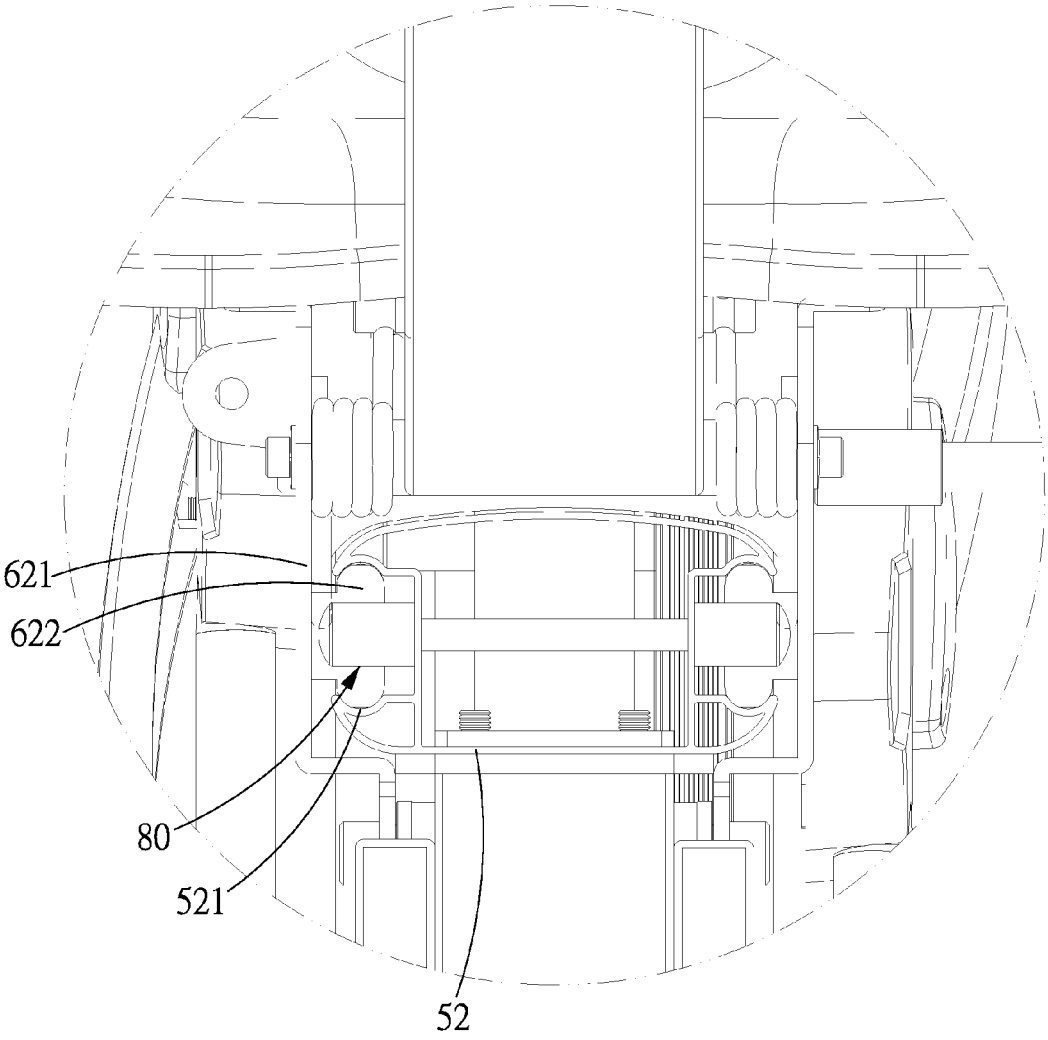
FIG. 4 is an enlarged view of a part of the recumbent fitness equipment in accordance with the present invention.
Figure 5:
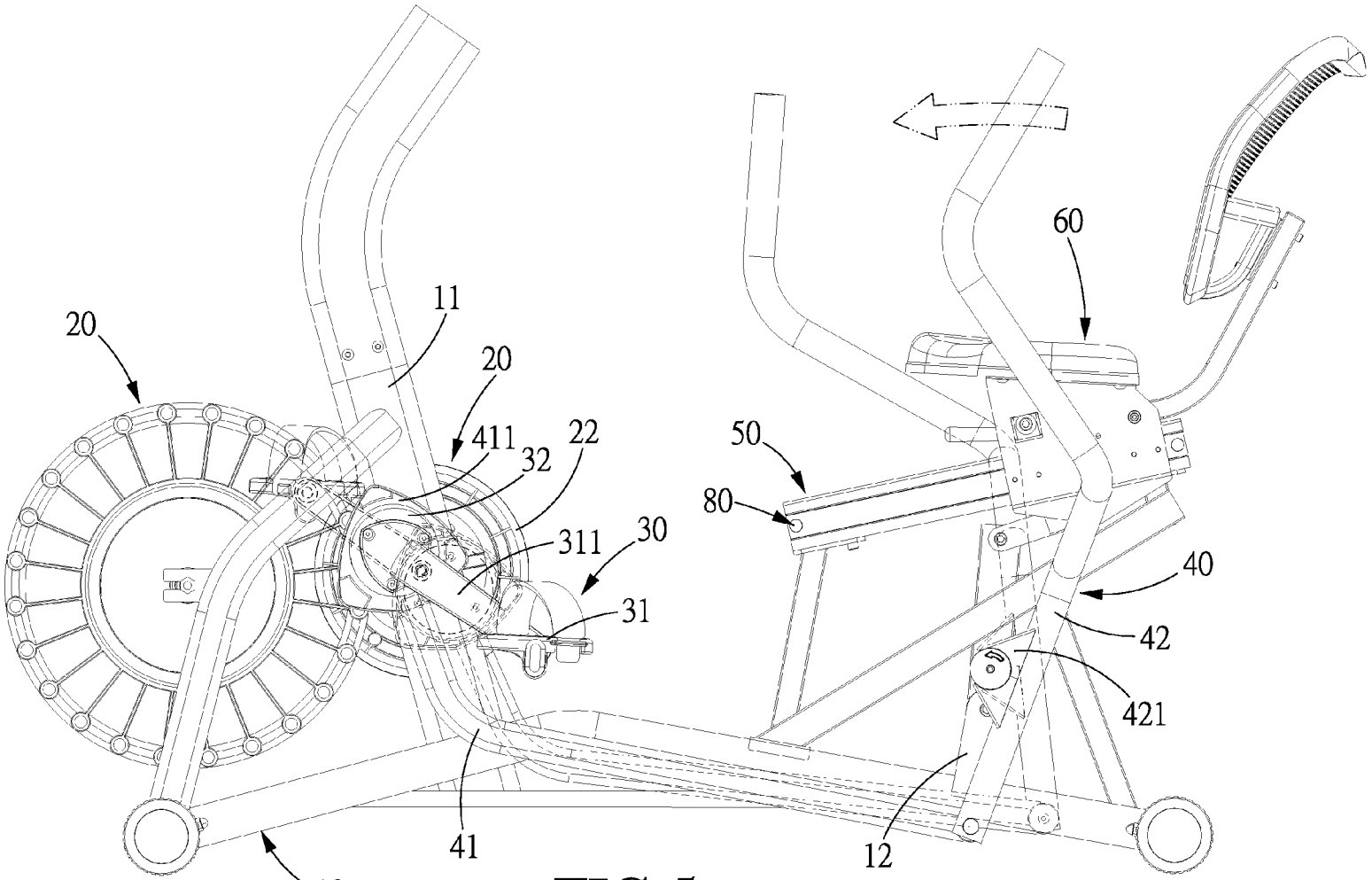
FIG. 5 is an operational view of the recumbent fitness equipment in accordance with the present invention.
Figure 6:
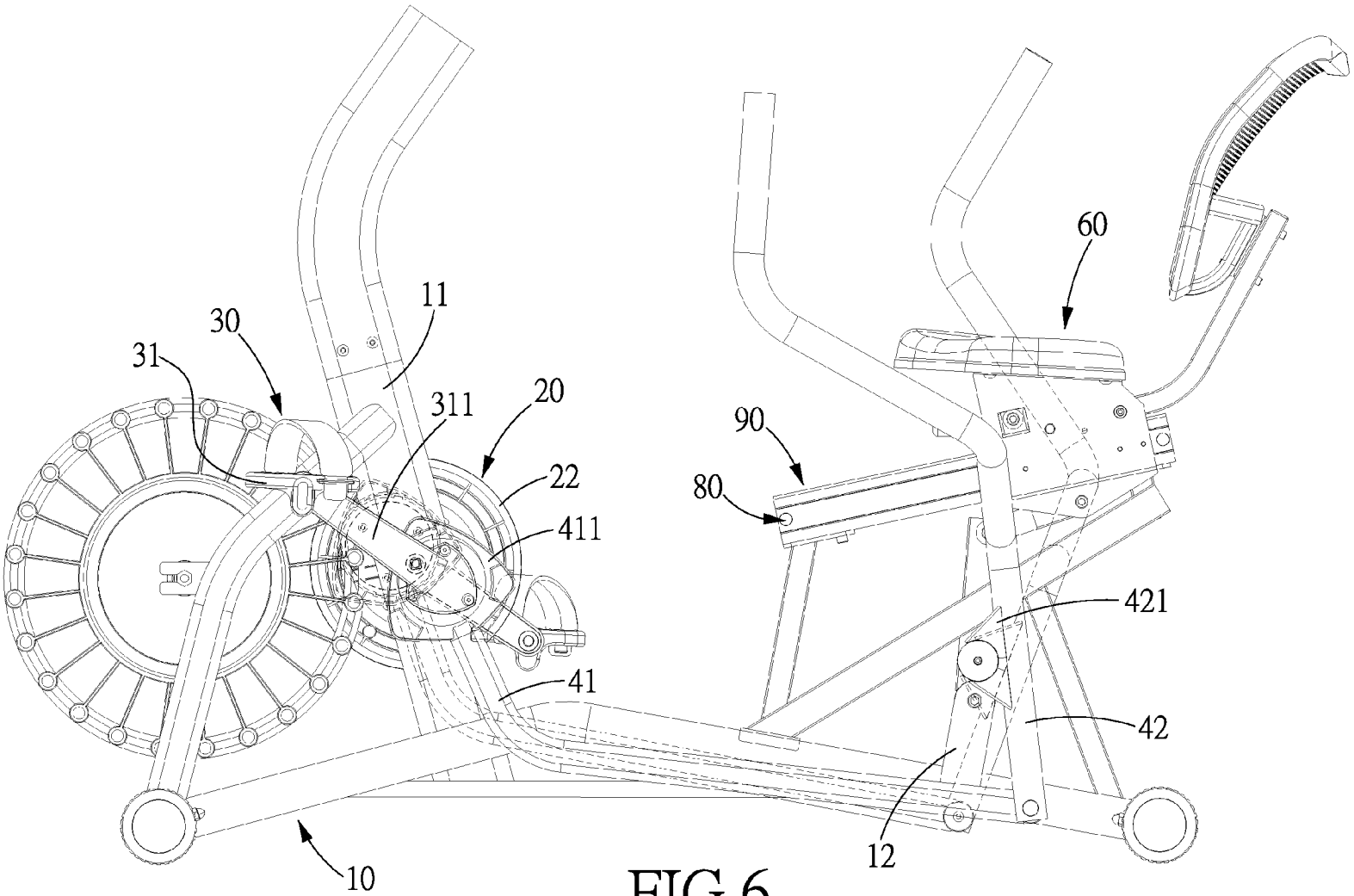
FIG. 6 is another operational view of the recumbent fitness equipment in accordance with the present invention.

The present invention will be clearer from the following description when viewed together with the accompanying drawings, which show, for purpose of illustrations only, the preferred embodiment in accordance with the present invention.

Referring to FIGS. 1-8, a recumbent fitness equipment with synchronized pedals and armrests and a seat adjustment device in accordance with a preferred embodiment of the present invention comprises: a frame 10, a rotary wheel assembly 20, a pair of pedal assemblies 30, a pair of armrests 40, a seat mounting rack 50, and a seat 60.

The frame 10 is provided with an upright pipe 11 and a support member 12.

The rotary wheel assembly 20 includes a belt wheel 22 and a gravity wheel 23 which is drivingly connected to the belt wheel 22 by a belt. The belt wheel 22 is rotatably fixed to the upright pipe 11 via a shaft 21 which is inserted through the upright pipe 11 and the belt wheel 22.

The pair of pedal assemblies 30 each include a pedal 31 with a crank 311 which is fixed to one end of the shaft 21 by a crank-fixing member 32. The crank-fixing member 32 includes an eccentric hole 321 via which the crank-fixing member 32 is sleeved onto the shaft 21 by a rotation-stop sleeve 33, then a nut 34 is used to fix the crank-fixing member 32 and the shaft 21. The pedal 31 has the crank 311 fixed to the crank-fixing member 32, so that the pedal 31 can drive the shaft 21 to rotate via the crank-fixing member 32, consequently, the shaft 21 drives the belt wheel 22 of the rotary wheel assembly 20 to rotate.

The pair of armrests 40 each include a connecting rod 41 and an armrest rod 42. The connecting rod 41 is an L-shaped rod extending to the support member 12 and has one end drivingly fixed to the crank-fixing member 32 by a connecting member 411 sleeved onto the crank-fixing member 32, and has another end pivoted to one end of the armrest rod 42. The armrest rod 42 is provided at a lateral side thereof with a pivot portion 421.

The seat mounting rack 50 includes a plurality of mounting rods 51 and a rail 52. The mounting rods 51 are fixed to the frame 10, and the rail 52 is fixed to the mounting rods 51 and includes two opposite guide portions 521. Each of the guide portions 521 is inclined toward the rotary wheel assembly 20, and in this embodiment, the two guide portions 521 are grooves.

The seat 60 includes a seat member 61, a slide member 62 and a shaft coupler 63. The seat member 61 is fixed on the rail 52, the slide member 62 includes two lateral pieces 621, and each of the lateral pieces 621 is provided with a slide block 622. Each of the lateral pieces 621 is slidably inserted in the rail 52, and the slide blocks 622 are movably inserted in the guide portions 521. The shaft coupler 63 includes a first section 631 and a second section 632, the first section 631 has one end pivoted to one end of the second section 632, and another end of the first section 631 is disposed between and pivotally connected to the two lateral pieces 621. Another end of the second section 632 is pivoted to the support member 12. The second section 632 is also pivotally connected to the pivot portion 421 of a corresponding one of the armrest rods 42 by a pivot shaft 70, so that the armrest rods 42 are able to rotate around the pivot shaft 70 to pivot with respect to the second section 632.

After the seat 60 is movably mounted on the seat mounting rack 50, a stop rod 80 is disposed at each of two ends of the seat mounting rack 50 to stop the seat 60 from moving out of the seat mounting rack 50. The seat 60 can also be fixed to a predetermined position on the seat mounting rack 50 by a fixing element 90.

The user can seat on the seat member 61 in an inclined or recumbent position, with feet on the pedal assemblies 30 and hands on the armrests 40. Then the user can stamp the pedals 31, the pedals 31 will rotate the crank-fixing members 32 with the cranks 311. Since the crank-fixing members 32 are eccentrically fixed to the shaft 21, they will rotate around the shaft 21 in an eccentric manner. When rotating, the crank-fixing members 32 will drive the shaft 21 and the gravity wheel 23 to rotate by using the rotation-stop sleeve 33, and the weight of the gravity wheel 23 produces a resistance to allow the user to do exercise.

When the pedal assemblies 30 are being stamped, the connecting rods 41 of the armrests 40 fixed to the crank-fixing members 32 will move along with the crank-fixing members 32 in an eccentric manner. When the connecting rods 41 move, the armrest rods 42 will be driven to pivot with respect to the second sections 632 by rotating around the pivot shaft 70, and the pivot motion of the armrest rods 42 makes the armrest rods 42 sway back and forth with respect to the seat member 61, and consequently making the hands of the user sway back and forth. Therefore, the hands and feet of the user can move at the time when the user is doing work out with the recumbent fitness equipment of the present invention.

Figure 7:
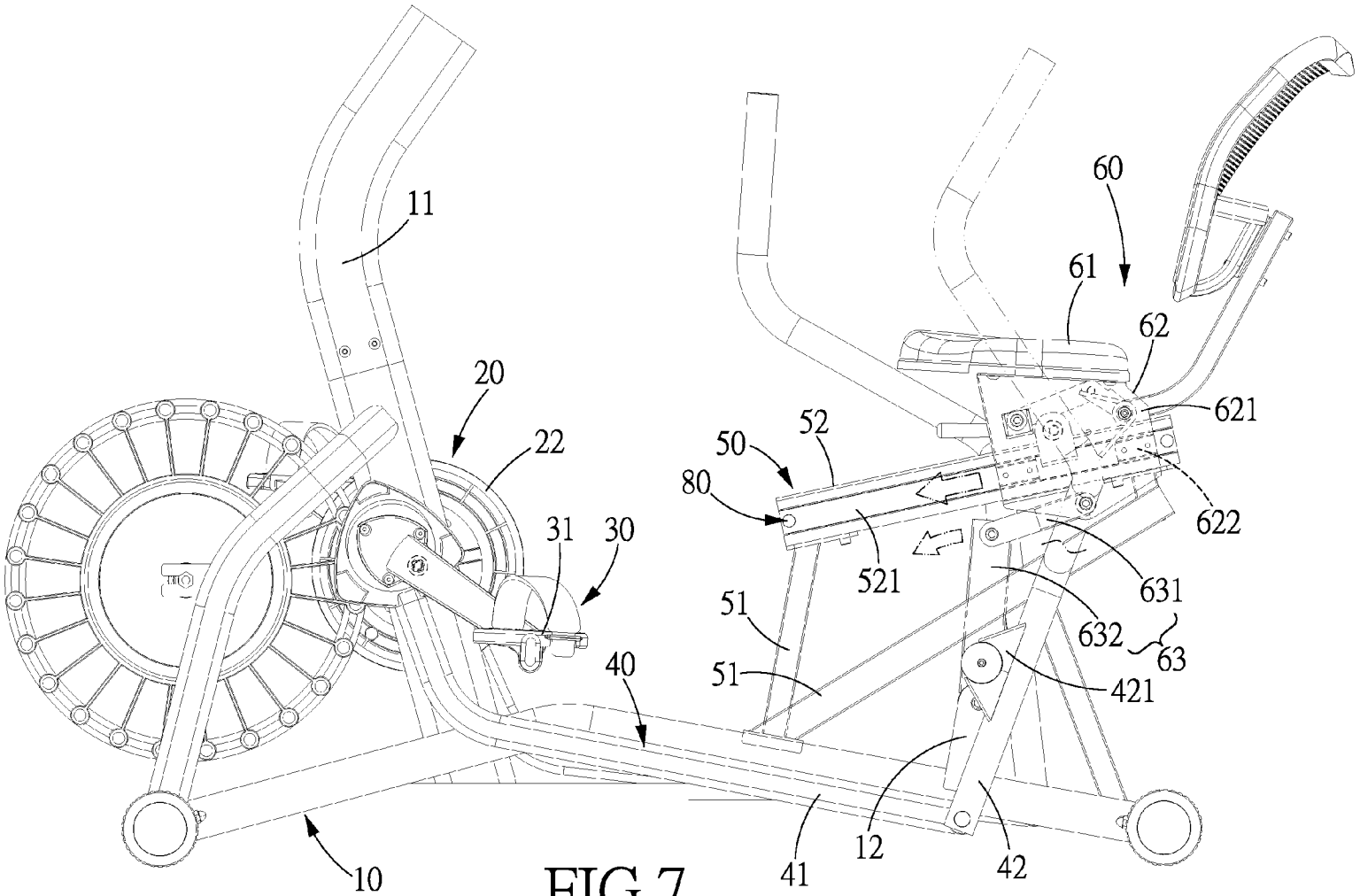
FIG. 7 is a side view of the recumbent fitness equipment in accordance with the present invention.
Figure 8:
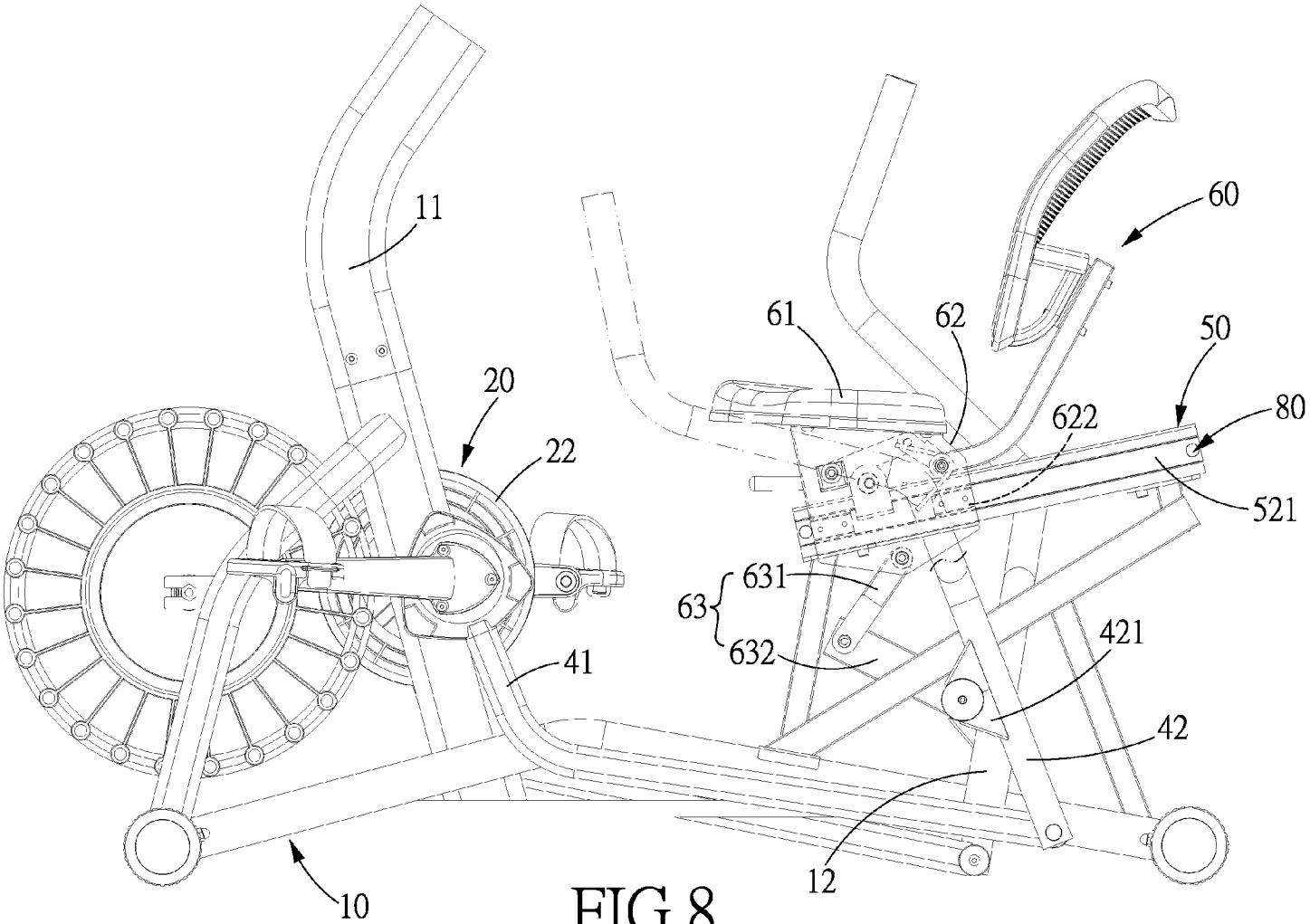
FIG. 8 is an operational view of the recumbent fitness equipment in accordance with the present invention.

When different users use the recumbent fitness equipment, such as a short user with short limbs, as shown in FIGS. 7 and 8, the slide member 62 of the seat can be pushed toward the rotary wheel assembly 20 by moving along the rail 52. At this moment, the slide member 62 pushes the first section 631 to move, and the first section 631 drives the second section 632 to pivot with respect to the support member 12, as shown in FIG. 8. The pivot motion of the second section 632 then makes the corresponding armrest rod 42 pivot toward the rotary wheel assembly 20. By such arrangements, the seat member 61 and the armrest rods 42 move synchronously toward the rotary wheel assembly 20 to reduce the distance from the seat member 61 and the armrest rods 42 to the pedal assemblies 30. Therefore, the recumbent fitness equipment in accordance with the present invention can be adjusted to meet the demands of different users.

When the user stamps the pedals, the armrests also move along with the pedals, so that the user's feet and hands can move simultaneously during exercise, so as to improve exercise effect. Besides, the distance from the seat member 61 and the armrest rods 42 to the pedal assemblies 30 can be adjusted to meet the demands of different users.

While we have shown and described various embodiments in accordance with the present invention, it is clear to those skilled in the art that further embodiments may be made without departing from the scope of the present invention.

What is claimed is:

1. A recumbent fitness equipment with synchronized pedals and armrests and a seat adjustment device, comprising:

a frame;

a rotary wheel assembly with a belt wheel and a gravity wheel which is drivingly connected to the belt wheel by a belt, the belt wheel being rotatably fixed to the frame via a shaft which is inserted through the frame and the belt wheel;

a pair of pedal assemblies each including a said pedal with a crank which is fixed to one end of the shaft by a crank-fixing member, the crank-fixing member including an eccentric hole via which the crank-fixing member is sleeved onto the shaft, the pedal being fixed to the crank-fixing member via the crank;

a pair of said armrests each including a connecting rod and an armrest rod, the connecting rod having one end drivingly fixed to the crank-fixing member by a connecting member which is sleeved onto the crank-fixing member, and having another end pivoted to one end of the armrest rod, the armrest rod being provided at a lateral side thereof with a pivot portion;

a seat mounting rack including a plurality of mounting rods and a rail, the mounting rods being fixed to the frame, and the rail being fixed to the mounting rods and inclined toward the rotary wheel assembly; and a seat with a seat member, a slide member and a shaft coupler, the seat member being fixed on the rail, the slide member being slidably inserted in the rail, the shaft coupler including a first section and a second section, the first section having one end pivoted to one end of the second section, and another end of the first section being pivotally connected to the slide member, another end of the second section being pivoted to the frame, the second section being pivotally connected to the pivot portion by a pivot shaft, so that the armrest rods are able to pivot with respect to the second section by rotating around the pivot shaft.

2. The recumbent fitness equipment with the synchronized pedals and armrests and the seat adjustment device as claimed in claim 1, wherein the frame is provided with an upright pipe and a support member, the belt wheel is rotatably fixed to the upright pipe via the shaft which is inserted through the upright pipe and the belt wheel, and the second section is pivoted to the support member.

3. The recumbent fitness equipment with the synchronized pedals and armrests and the seat adjustment device as claimed in claim 1, wherein the crank-fixing member is sleeved onto the shaft by a rotation-stop sleeve, and then a nut is used to fix the crank-fixing member and the shaft.

4. The recumbent fitness equipment with the synchronized pedals and armrests and the seat adjustment device as claimed in claim 1, wherein the frame is provided with an upright pipe and a support member, the belt wheel is rotatably fixed to the upright pipe via the shaft which is inserted through the upright pipe and the belt wheel, and the second section is pivoted to the support member, and the connecting rod is an L-shaped rod extending to the support member.

5. The recumbent fitness equipment with the synchronized pedals and armrests and the seat adjustment device as claimed in claim 1, wherein the rail includes two opposite guide portions which are grooves inclined toward the rotary wheel assembly, the slide member includes two lateral pieces, each of the lateral pieces is provided with a slide block and slidably inserted in the rail, and the slide blocks are movably inserted in the guide portions.

6. The recumbent fitness equipment with the synchronized pedals and armrests and the seat adjustment device as claimed in claim 1, wherein the slide member includes two lateral pieces, and another end of the first section is disposed between and pivotally connected to the two lateral pieces.

7. The recumbent fitness equipment with the synchronized pedals and armrests and the seat adjustment device as claimed in claim 1, wherein the seat is movably mounted on the seat mounting rack, then a stop rod is disposed at each of two ends of the seat mounting rack to stop the seat from moving out of the seat mounting rack, and the seat is fixed to a predetermined position on the seat mounting rack by a fixing element.

* * * * *